US010713896B2

(12) United States Patent
Berman et al.

(10) Patent No.: US 10,713,896 B2
(45) Date of Patent: Jul. 14, 2020

(54) GAMING DEVICES WITH CHOICE OF COLLECTING OR SURRENDERING AWARD

(71) Applicant: KING SHOW GAMES, INC., Minnetonka, MN (US)

(72) Inventors: Bradley Berman, Minnetonka, MN (US); Jacob Lamb, Maple Grove, MN (US)

( * ) Notice: Subject to any disclaimer, the term of this patent is extended or adjusted under 35 U.S.C. 154(b) by 232 days.

(21) Appl. No.: 15/800,726

(22) Filed: Nov. 1, 2017

(65) Prior Publication Data

US 2018/0130306 A1 May 10, 2018

Related U.S. Application Data

(60) Provisional application No. 62/419,412, filed on Nov. 8, 2016.

(51) Int. Cl.
*G07F 17/32* (2006.01)
*G07F 17/34* (2006.01)

(52) U.S. Cl.
CPC ..... *G07F 17/3267* (2013.01); *G07F 17/3211* (2013.01); *G07F 17/3258* (2013.01); *G07F 17/34* (2013.01)

(58) Field of Classification Search
CPC ... G07F 13/32; G07F 13/3267; G07F 13/3262
See application file for complete search history.

(56) References Cited

U.S. PATENT DOCUMENTS 6,315,660 B1 * 11/2001 DeMar ..... G07F 17/32 273/138.2
2003/0045350 A1 * 3/2003 Baerlocher ..... G07F 17/32 463/25
2005/0143170 A1 6/2005 Maya et al.
2009/0176554 A1 * 7/2009 Vallejo ..... G07F 17/32 463/20
2010/0124973 A1 * 5/2010 DeWaal ..... G07F 17/3244 463/20
2010/0203964 A1 8/2010 Berman
2011/0045898 A1 * 2/2011 Anderson ..... G07F 17/32 463/25
2011/0111845 A1 * 5/2011 Fitzsimons ..... G07F 17/3227 463/27
2011/0124402 A1 * 5/2011 De Waal ..... G07F 17/3244 463/25

(Continued)

*Primary Examiner* — James S. McClellan
*Assistant Examiner* — Kevin M Carter

(57) ABSTRACT

Systems, apparatuses and methods for providing options in gaming activities to take an offered award or to surrender it to play for more favorable awards. In one embodiment, a number of available awards are presented and at least one is selected for or by the player. The player can choose to keep the current award, or to surrender it to obtain a chance to obtain a different award. If the player surrenders the current award, the player is provided with selectable award advancement alternatives from which to select, including an option to obtain a new award positioned relative to the surrendered one of the available awards and an option requiring that the surrendered one of the available awards be retained. In response to the player selecting the option to obtain a new award positioned relative to the surrendered one of the available awards, the new award is identified.

18 Claims, 7 Drawing Sheets

(56) References Cited

U.S. PATENT DOCUMENTS

| | | | | |
|---|---|---|---|---|
| 2011/0218030 | A1 | 9/2011 | Acres | |
| 2012/0122532 | A1* | 5/2012 | Berman | G07F 17/3244 463/11 |
| 2012/0258783 | A1* | 10/2012 | Chan | G07F 17/34 463/20 |
| 2014/0031099 | A1* | 1/2014 | Williams | G07F 17/3262 463/20 |
| 2016/0148462 | A1 | 5/2016 | Jhanb et al. | |
| 2016/0171831 | A1 | 6/2016 | Gagner et al. | |
| 2017/0352232 | A1 | 12/2017 | Acres | |
| 2018/0089947 | A1* | 3/2018 | Mariscal | G07F 17/3209 |

* cited by examiner

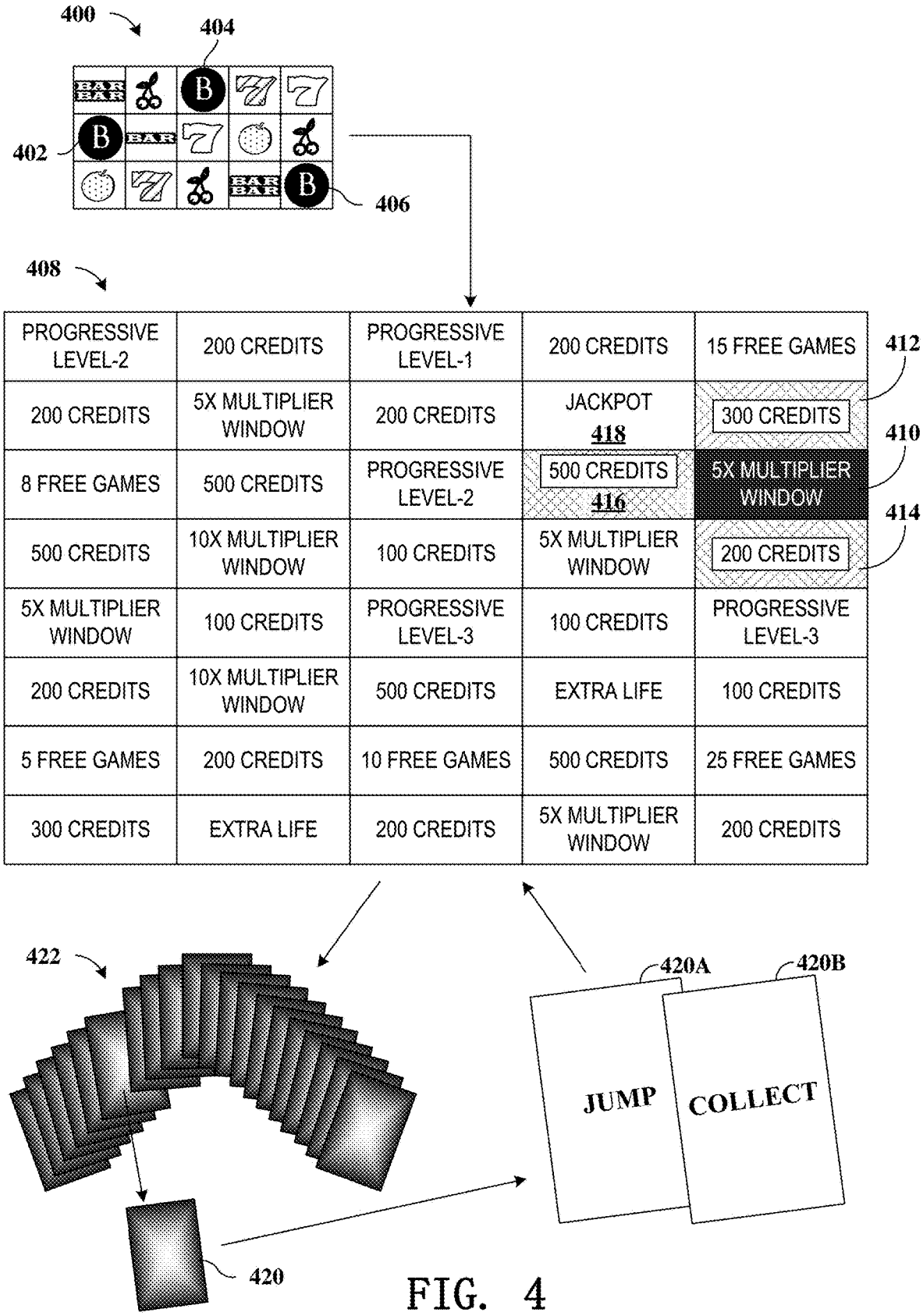

| | | | | |
|---|---|---|---|---|
| PROGRESSIVE LEVEL-2 | 200 CREDITS | PROGRESSIVE LEVEL-1 | 200 CREDITS | 15 FREE GAMES |
| 200 CREDITS | 5X MULTIPLIER WINDOW | 200 CREDITS | JACKPOT 418 | 300 CREDITS |
| 8 FREE GAMES | 500 CREDITS | PROGRESSIVE LEVEL-2 | 500 CREDITS 416 | 5X MULTIPLIER WINDOW |
| 500 CREDITS | 10X MULTIPLIER WINDOW | 100 CREDITS | 5X MULTIPLIER WINDOW | 200 CREDITS |
| 5X MULTIPLIER WINDOW | 100 CREDITS | PROGRESSIVE LEVEL-3 | 100 CREDITS | PROGRESSIVE LEVEL-3 |
| 200 CREDITS | 10X MULTIPLIER WINDOW | 500 CREDITS | EXTRA LIFE | 100 CREDITS |
| 5 FREE GAMES | 200 CREDITS | 10 FREE GAMES | 500 CREDITS | 25 FREE GAMES |
| 300 CREDITS | EXTRA LIFE | 200 CREDITS | 5X MULTIPLIER WINDOW | 200 CREDITS |

FIG. 4

GAMING DEVICES WITH CHOICE OF COLLECTING OR SURRENDERING AWARD

FIELD

This disclosure relates generally to games, and more particularly to systems, apparatuses and methods for providing options in gaming events to accept or risk awards.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to provide options in gaming events to accept or risk award. For example, one embodiment involves systems, apparatuses, computer-readable media, and/or methods that involve or otherwise facilitate providing an option in a base game or bonus/auxiliary game feature to take an offered award or risk it to try to obtain a more favorable award.

In one embodiment, a slot game device/apparatus is provided that includes at least a display, user interface, wager input device, and processor. The display presents symbol locations that form a symbol array. The user interface includes at least one user input to enable a player to initiate a slot game event presented via the symbol array. The wager input device is structured to identify and validate player assets, and to permit the player to play the slot game event when the player assets are provided. The processor is configured with software to create operational modules to provide a number of available awards, and randomly select one of the available awards. In various embodiments, the random selection may be by the device/apparatus, or by the player. The processor is further configured to create operational modules to provide the player an option to keep a currently-selected one of the available awards or to surrender the currently-selected one of the available awards for a chance to obtain a different award. In response to the player surrendering the currently-selected one of the available awards, the processor is configured to provide the player a plurality of hidden (until selected) selectable award advancement alternatives from which to select, including an option to obtain a new award positioned relative to the surrendered one of the available awards and an option requiring reinstatement of the surrendered one of the available awards. In response to the player selecting the option to obtain a new award positioned relative to the surrendered one of the available awards, the processor is configured to identify the new award among the plurality of available awards.

According to more particular embodiments of such a slot game device, the processor may be configured to provide the plurality of available awards on a visible grid having respective ones of the available awards in different segments of the visible grid. This may be done such that the available awards having a relatively high value are separated by at least one of the available awards having a relatively low value.

In another embodiment, the processor may be configured to provide the plurality of available awards on a visible rotatable wheel having respective ones of the available awards in different segments of the visible rotatable wheel. This may be done such that the available awards having a relatively high value are separated by at least one of the available awards having a relatively low value.

In still other embodiments of such a slot game device, the processor may be configured to identify the new award by selecting one of the plurality of available awards based on its relative position to the currently-selected one of the available awards. In other embodiments, the processor is further configured to enable player selection of any one of a plurality of the available awards that are within a predetermined proximity of the currently-selected one of the available awards. In various embodiments, the new award may have a value that is lower, or higher, than the previously selected one of the available rewards.

In another embodiment, a slot game device is provided that includes at least a display, user interface, wager input device, and processor. The display presents symbol locations that form a symbol array. The user interface includes at least one user input to enable a player to initiate a slot game event presented via the symbol array. The wager input device is structured to identify and validate player assets, and to permit the player to play the slot game event when the player assets are provided. The processor is configured with software to create operational modules to offer a current award from a plurality of available awards, and facilitate player acceptance or rejection of the current award. In response to player rejection of the current award, the processor is configured to provide a plurality of concealed new award offer options to the player, where the plurality of new award offer options include at least an offer for a different award from the plurality of available awards to replace the current award, and a directive to retain the current award. The processor is configured to facilitate player selection of one of the plurality of new award offer options, grant the current award if the player selection resulted in the directive to retain the current award, and establish the different award as the current award if the player selection resulted in the offer for the different award. In the case where the player has elected to surrender the current award to try to get a different award, the process can continue by reoffering the new award to the player, enabling the player to accept or reject the new award, provide new award offer options to the player from which the player can select, etc.

In more particular embodiments of such a slot game device, the processor may be configured to grant the current award to the player, and discontinue further processing of new awards, in response to player acceptance of the current award.

In other embodiments, the processor is configured to cause the display to present the plurality of available awards on a grid, where in yet other embodiments, the processor is configured to cause the display to present the plurality of available awards on a rotatable wheel.

In another embodiment of such a slot game device, the processor is configured to offer a current award from a plurality of available awards by randomly identifying the current award from a grid having grid positions each respectively providing one of the plurality of available awards. In another embodiment, the processor is configured to provide the new award offer option of an offer for a different award by providing an offer for one of the plurality of available awards positioned in one of the grid positions adjacent to the grid position of the current award.

In still another embodiment of such a slot game device, the processor is configured to offer a current award from a plurality of available awards by randomly identifying the current award from a segment of an electronic rotatable wheel having multiple segments each respectively providing one of the plurality of available awards. In another embodiment, the processor is configured to provide the new award offer option of an offer for a different award by providing an offer for one of the plurality of available awards positioned in one of the segments of the wheel positioned adjacent to the segment of the wheel of the current award.

Another embodiment of such a slot game device involves the processor configured to offer the current award from the plurality of available awards in connection with a bonus event triggered by a predetermined symbol or combination of symbols in the symbol locations of the symbol array.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

BRIEF DESCRIPTION OF THE DRAWINGS

FIG. 4 illustrates an embodiment where the gaming award selection feature is provided in a bonus event of a slot game.

DETAILED DESCRIPTION

Figure 1:
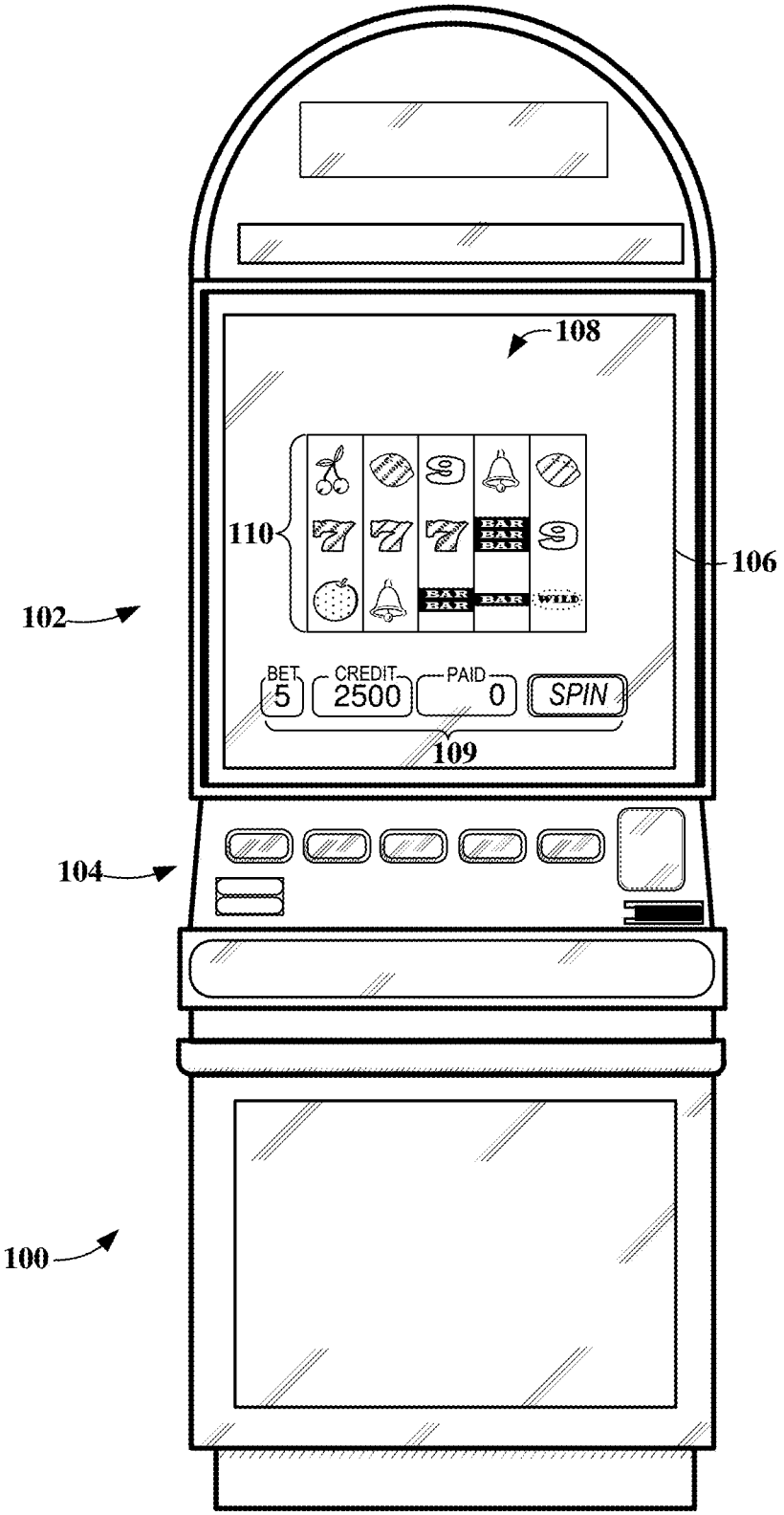
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for providing gaming awards, and facilitating a player's acceptance of the award, or surrender of the award in an effort to obtain a more favorable award. Embodiments include providing an option in a bonus to take an offered award or risking it to play for a bigger and/or more favorable award in the bonus in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that enables offered awards to be rejected, and risked, in favor of potentially obtaining a better award. These systems, apparatuses and methods, in various embodiments, utilize operations of providing an option in a bonus to take an offered award or risking it to play for a bigger award in the bonus. In one embodiment, a method of operating a gaming device includes a pick bonus in which player is randomly placed on a grid of possible bonus rewards. The player may then choose between sticking with the reward associated with the grid position they are currently on, or selecting a jump card which will either move them to an adjacent reward or end the bonus, awarding them their current award.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of the concepts taught herein.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
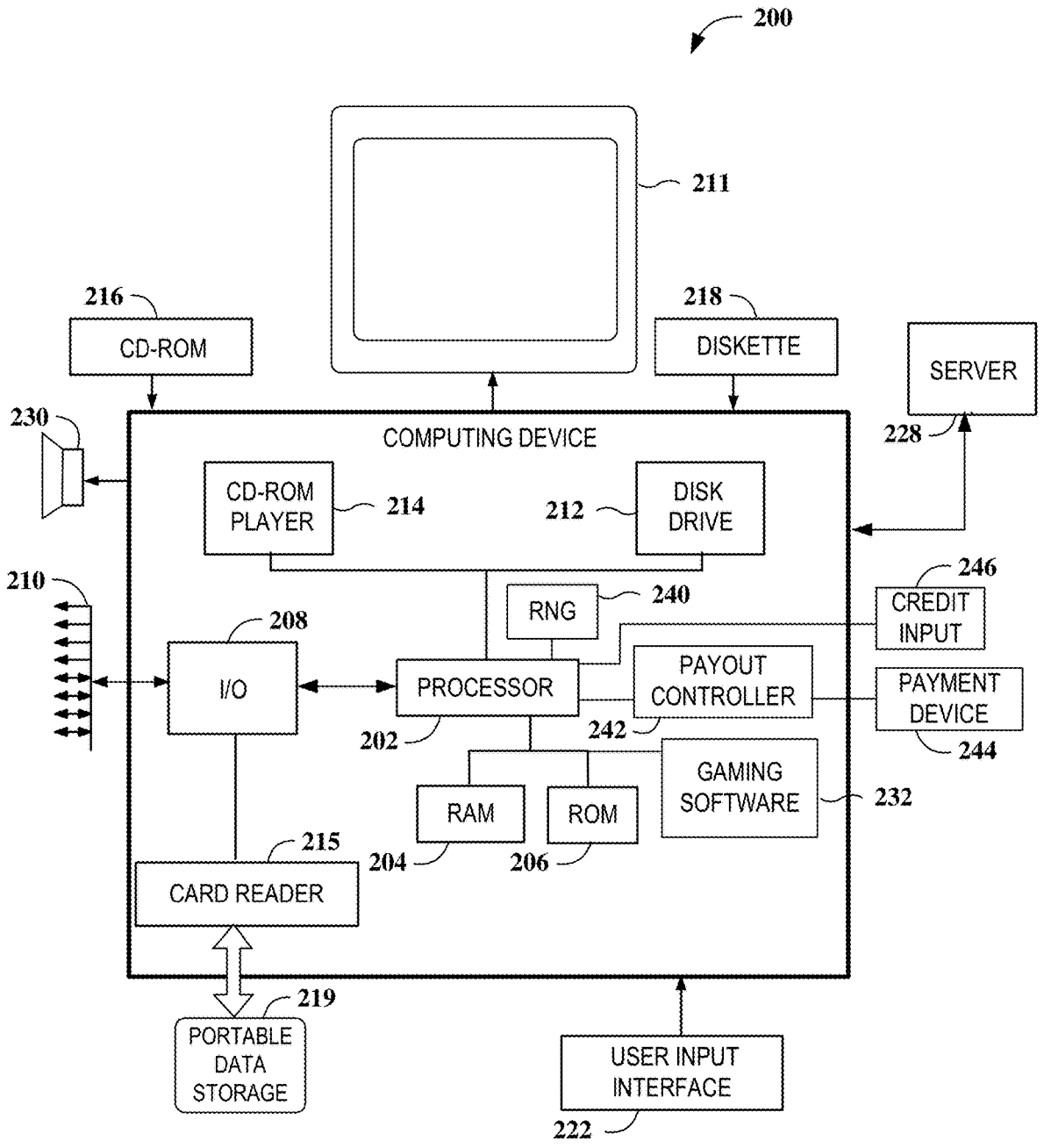
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM), or any technology capable of storing data. The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

As described above, embodiments of the present concept include providing gaming systems, gaming devices, and methods of operating these systems/devices to provide game play that utilizes operations, for example, of providing an option in a bonus to take an offered award or risk it to play for a different, hopefully more preferable, award in a gaming bonus feature. In one embodiment, a method of operating a gaming device includes a pick bonus in which player is randomly placed on a grid of possible bonus rewards. The player may then choose between sticking with the reward associated with the grid position they are currently on, or selecting a jump card which will either move them to an adjacent reward or end the bonus, awarding them their current award.

Figure 3:
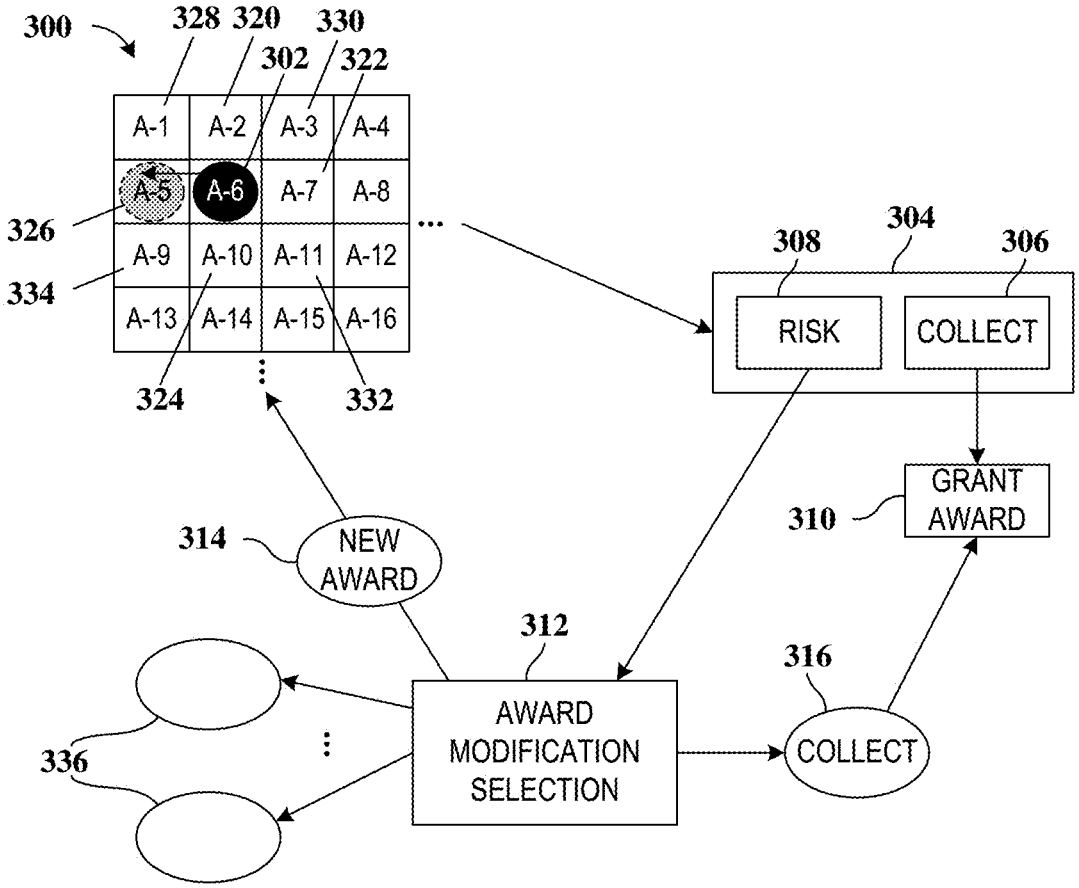
FIG. 3 depicts one embodiment of a gaming award selection feature according to the principles described herein.

FIG. 3 depicts one embodiment of a gaming award selection feature according to the principles described herein. The feature may be associated with a primary or base game, or may be associated with some auxiliary gaming feature of such a game, such as a bonus feature that is available in response to some other gaming event or random occurrence. For purposes of the description of the embodiment of FIG. 3, it is not relevant what triggered the feature.

In this embodiment, something in the base game, bonus game, etc. provides a manner in which a plurality of potential gaming awards are presented, with (at least) one of the gaming awards being identified as awarded to the player. In the example of FIG. 3, the potential gaming awards are presented as a grid 300 of awards, depicted as awards A-1 through A-16, which are visible to the player in one embodiment (and not visible to the player until a selection is made in other embodiments). All of these awards may be unique relative to one another, or some may represent the same award. These awards may include, for example, indications of credits won, free games, modifiers (e.g., payout multipliers), progressive jackpots, and/or anything else that may have value to the player. In one embodiment, one or more of the available "awards" may be a zero or no award, a negative or detrimental award, etc. However, in one embodiment, each of the available awards in the grid 300 may at least potentially provide additional gaming assets to the player.

In one embodiment, the award that is initially granted to the player is randomly selected. In the example of FIG. 3, award A-6 302 has been randomly identified as an award offered to the player. As noted above, this may be provided in connection with a bonus game, such as when some gaming triggering event occurs (including a mystery/random bonus) that presents the grid 300. In accordance with the principles described herein, the player may then be offered a choice whether to keep the originally offered award A-6 302, or to surrender the offered award and risk its value in the hopes of obtaining a better award. While such player decision may be presented to the player and managed in any desired way, FIG. 3 depicts a user interface 304 having at least a collect user input 306 to retain and therefore collect the offered award A-6-302, and a risk input 308 to surrender the offered award A-6 302 and work towards obtaining a better award, with the knowledge that what might be subsequently obtained may be less favorable than the award A-6 302 that was already offered to the player.

If the player chooses to collect the offered award (e.g., by way of the representative collect user input 306), that offered award (A-6 302 in this example) is then granted 310 to the player. In one embodiment, the gaming/bonus feature then ends, although in other embodiments, the process may be performed multiple times. If the player chooses to risk the offered award (e.g., by way of the representative risk user input 308), the player may responsively be presented with some manner of adjusting the offered award on the grid 300.

For example, the award modification selection module 312 may include a plurality of available actions, such as one or more new award actions 314, and a collect action 316. The particular action selected may automatically be randomly selected for the player, or the player may be provided an opportunity to make a random selection that identifies the action made available to the player. For example, the player may be allowed to select from a plurality of hidden actions, where a selected action is presented to the player upon its selection. As other embodiments herein described, such selection may be performed in any desired manner, such as selecting one of a plurality of action icons, one of a plurality of cards, etc.

In this example, assume that the award modification selection module 312 enables the player to select a card from a plurality of cards, one or more of which identify an award collect action 316, and one or more of which identify a new award action 314. If the player selects a collect action 316, then the player is granted the original award A-6 302, i.e. the selection did not result in enabling the player to further the attempt to get a better award. In such case, the player receives the award A-6 302, and the gaming feature/bonus then ends in some embodiments.

On the other hand, if the player selects a new award action 314, then depending on the game rules, the player will be directed to the grid 300 to obtain a new award offer. For example, the game rules may indicate that receipt of a new award action 314 allows the player to select, as a new award offer, any award in the grid 300 that is adjacent to the previously offered award. Adjacency may be defined as sharing a linear border (e.g., awards A-2 320, A-7 322, A-10 324, A-5 326), or may be defined to further include diagonally adjacent (e.g., further including awards A-1 328, A-3 330, A-11 332, A-9 334). In these embodiments, the player may select among the visible adjacent awards on the grid 300, choosing a more desirable award, if one exists.

The player may continue to risk offered awards to move towards a desired award, such as a major jackpot award or other high-value award. While iteratively moving towards a desired destination on the grid 300, the player may obtain a collect action 316, which ends the bonus. Thus, the player may risk larger award payouts and move through smaller or less desirable payouts, in the hopes of obtaining an even larger payout. One risk is that the player may be forced to take a less desirable payout along the way, as a result of getting a collect action 316 card or other lesser result (e.g., one or more other cards may have set credit values or other awards that cause the bonus to end). In this manner, the player may take repeated steps in an effort to reach a desired award on the grid 300.

In other embodiments, new award actions 314 may have other instructions, such as move two spaces in any direction or in a particular direction (and wrap around when reaching the grid 300 border), move in a pattern, move to a random location, etc. For example, an new award action 314 may specify a direction and number of grid locations that the player must move relative to the current award position A-6 302. One example is that award A-2 320 is a major jackpot award, so the player risks the A-6 302 award in the hopes of being moved to the A-2 320 major jackpot. If the received new award action 314 indicates that the player must move downward one location, the player then is offered the award A-10 324 rather than what the player hoped for which was award A-2 320.

In another embodiment, the selection to collect the offered award or risk it (e.g., via user interface mechanisms 306, 308 respectively) is not performed. In such an embodiment, the player is automatically presented with the choice of actions from the award modification selection module 312, such as selecting a card from a plurality of cards.

FIG. 4 illustrates an embodiment where the gaming award selection feature is provided in a bonus event of a slot game. The slot game grid 400 includes a grid of symbol locations in which gaming symbols are presented. The gaming award selection feature described herein may be triggered in any desired fashion, including randomly such as in a mystery bonus, based on a predetermined symbol combination(s), etc. In the illustrated embodiment, it is assumed that a predetermined combination of bonus symbols will trigger the gaming award selection feature described herein, such as receiving three bonus symbols 402, 404 and 406 anywhere on the slot game grid 400.

In the illustrated embodiment, when the bonus feature is triggered, an award grid 408 is presented to the player. The award grid 408 includes multiple award indications in the spaces of the grid 408. The grid may be any shape, size, number, etc. In this embodiment, the award grid 408 has 40 different award indications, including credit awards, free game/spin awards, progressive jackpots, multiplier windows that remain active for some number of games/spins, extra lives (e.g., to overcome a "collect" directive when the player wants to try to continue risking awards for different awards), and/or any other desired award.

In one embodiment, at least one of the award indications in the award grid 408 is randomly selected and presented to the player. The embodiment of FIG. 4 depicts award 410 as the randomly selected award, which is a 5× multiplier window in this example. The 5× multiplier window would, for example, enable the player to multiply any winnings for some number of spins by five.

In accordance with one embodiment, the player is then allowed to either keep the granted award 410, or surrender it in an attempt to obtain what the player may believe to be a better award, or to obtain a lesser award but to attempt to move in the direction of a better award. If the player chooses to keep the granted award 410, the bonus event may end, and the player is awarded the award that he/she chose to keep. If the player chooses to risk the granted award 410, a random award modification instruction may be presented to the player. For example, the random award modification instruction may require that the player keep the current award, thereby discontinuing the player's attempt to improve the award. The award modification instruction may alternatively provide the player with a new position on the grid 408, or provide an instruction of where the new award is positioned relative to the award that is being surrendered in favor of the new award.

In one embodiment, rather than being presented with an award modification instruction, the player may again be allowed to select from a plurality of selectable items to determine what the award modification instruction will be. The selection, in one embodiment, is performed without knowledge of which award modification instruction is being selected, but rather is a blind or random selection. FIG. 4 depicts an embodiment of a selection process where the player is allowed to select one of a plurality of selectable items, such as selecting a card 420 from a presentation of some number of cards such as a deck 422 of cards. Each of the cards may include any number of instructions to point the player to a new position on the grid 408, collect the current award, etc. In this example, it is assumed that each of the cards of the deck 422 has either a jump 420A indication or a collect 420B indication. In one embodiment, picking a collect 420B card causes the existing/surrendered award 410 to be reinstated for the user, and the bonus ends. Picking a jump 420A card causes a new award on the grid 408 to be identified for the player. Depending on the established rules, the new award may be selected from the grid 408 at a position relative to the existing, prior award 410. For example, if the rules indicate that the new award is adjacent to and shares a border with the prior award 410, then the player may be allowed to select one (or more in some embodiments) of the awards 412 (300 credits), 414 (200 credits), or 416 (500 credits). In one embodiment, upon making such a selection, the process can continue, where the player is given an opportunity to keep or risk the new award (e.g., 412, 414 or 416), and thereby continue to try to improve the granted award.

As an example, assumed that a player has received a bonus feature due to the presentation of three bonus symbols 402, 404, 406, thereby presenting the award grid 408, and the initial award 410 to the player. The player chooses to risk the offered award 410 of 5× multiplier window to get a more favorable bonus award, and thereby notifies the system/device of this choice (e.g., via a user interface). The player is presented with a deck 422 of cards, and the player selects one card 420, which turns out to be a jump card 420A, with game rules that the player is allowed to select a new award that is adjacent to the prior award 410. This returns the player to the grid 408 where such selection may be made. Assume that the player ultimately has his/her eye on the jackpot 418 award, which may be a large award relative to other awards in the grid 408. The player therefore knows that award 412 or 416 would move the player one step closer to the jackpot award 418. Assume the player selects award 416 (500 credits), and then is again presented with the choice to either keep the award 416, or surrender it try for a new award again. By separating the larger awards from smaller awards, the player may ultimately surrender a relatively large award to ultimately reach an even larger award, while being forced to stop on smaller intermediate awards than were previously surrendered by the player where a collect card 420B may end the bonus feature with the smaller award. However, if the player obtains enough jump cards 420A, a targeted award on the grid 408 may be obtained.

Accordingly, in some embodiments, after the bonus is triggered, a player icon or chip is placed on a credit value in a grid 408 like the one shown in FIG. 4. The player is then presented with a deck 422 of "jump cards." There are two types of cards in the deck: Jump 420A and Collect 420B. Here, the player has the option of taking the award covered by their chip or drawing a card from the deck 422. If the player draws a Jump card 420A, they are allowed to move their chip one space and they are presented with the option to draw again. If the player draws a Collect card 420B they are awarded the value covered by their chip on the grid 408. The awards on the board may be highly varied in value, from small/medium credit values to large progressives, base game multiplier windows, free games triggers, a jackpot, and/or other desired awards. If the player found themselves on a "premium" value, they may have to decide whether to risk it in order to move to better premium value. In one embodiment, no two premium values are adjacent to one another, to increase the player intrigue. According to other embodiments, instead of Jump and Collect cards 420A, 420B, the Jump cards 420A may specify a direction where the player's chip will move next. This may move the player away from an award they were hoping to move to. Consequently, where all or some of the Jump cards 420A include a direction of movement from the current spot on the grid 408, the direction may in fact move away from where the player had hoped to move on the grid 408, thereby making the risk versus reward balance and associated decisions interesting and challenging to the player.

In various embodiments, the "movement rules" of the game are known to the player, and therefore the player has some sense of the balance of risk versus reward. For example, if the movement rules of the game indicate that a jump card 420A results in user-selected movement choice (in some embodiments), or game-selected movement choice (in other embodiments) to a position with no intermediate symbols (e.g., adjacent on at least both borders and corners), adjacent on rectangular borders, within two (or more) awards on the grid 408, whether direction can be selected or is provided via the available jump options, etc. By knowing these established movement rules, the player can make decisions to try to move about the grid 408 to ultimately reach a desired award, or at least an improved award, knowing that intermediate steps may risk what was already had. In other words, while the player may choose to try to jump multiple awards on the grid 408 to reach a desired award, a collect card 420B may occur during that trek through the grid, resulting in a lesser award than might have already been available to retain.

Figure 5:
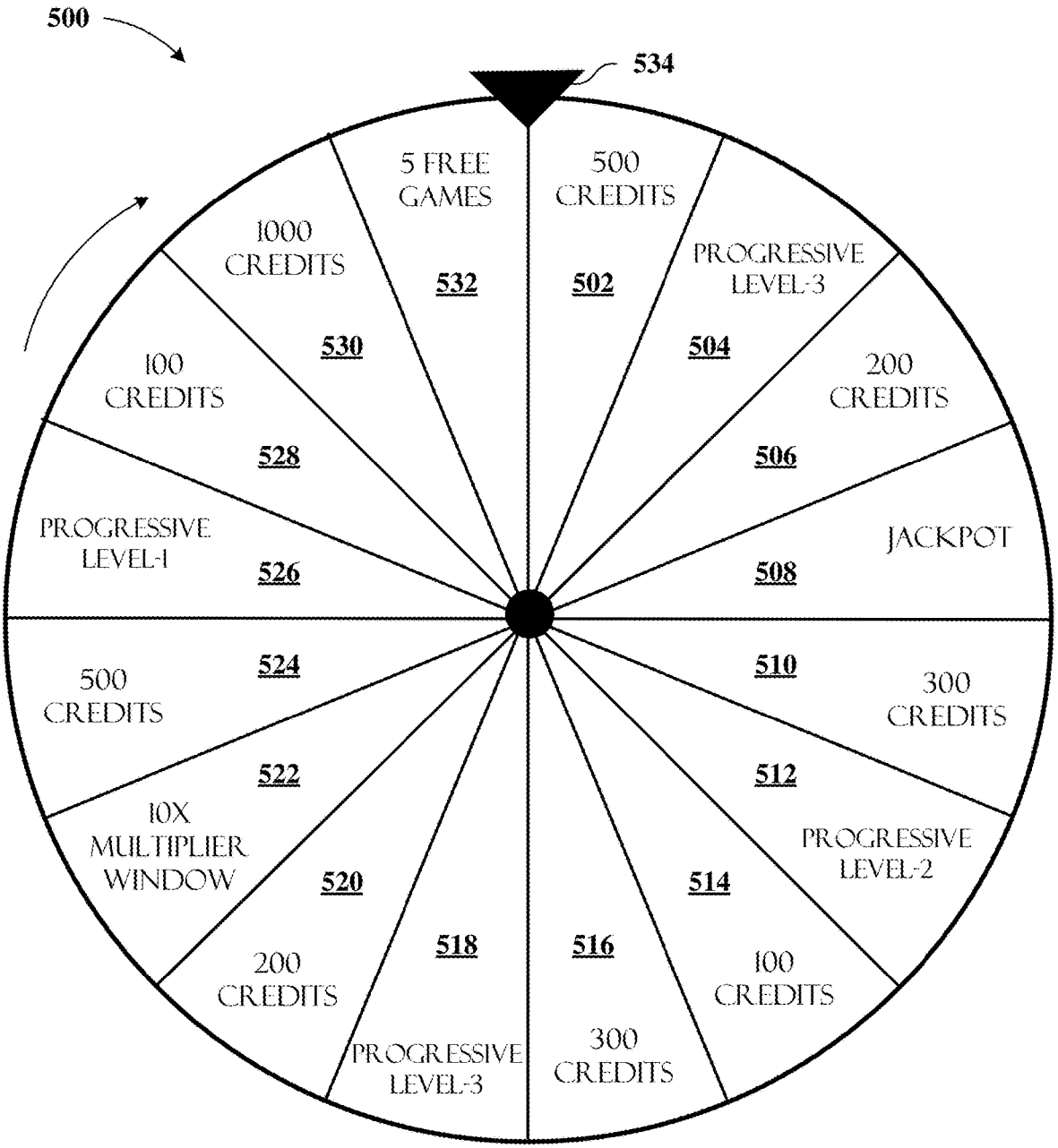
FIG. 5 illustrates an alternative manner for presenting available awards in a gaming award selection feature.

Other embodiments involve arranging or presenting the available awards in other manners, different from a grid (e.g., grid 408 of FIG. 4), such as onto a wheel 500 as shown in FIG. 5. The wheel 500, as well as the grid 408 or other manner of presenting awards, may be a physical structure or electronically depicted (e.g., virtual grid or virtual wheel). The wheel 500 may have as many segments or "wedges" as desired, and awards may be unique on each segment or there may be duplicates of one or more awards. The representative wheel 500 includes sixteen segments, each having an award associated therewith. For example, segments 502, 506, 510, 514, 516, 520, 524, 528, and 530 each have a credit value associated therewith. Segments 504, 512, 518, and 526 are each associated with progressive jackpots, and segment 508 is associated with the largest jackpot. Other awards may be provided such as depicted at segment 532 which awards free games, segment 522 which awards a multiplier window, etc.

In one embodiment, the player begins the bonus feature by spinning the wheel 500 to receive a random award. The player may then have the option of taking the award shown, or voluntarily surrendering the award for a chance to get a new more favorable award. In an embodiment using a group of cards such as described in connection with FIG. 4, the player may select a card, which is either a jump card 420A or collect card 420B (see FIG. 4) in this example. If the player selects the collect card, the award identified by the award indicator 534 is awarded, and in one embodiment the bonus ends. If the player selects the jump card, the wheel 500 (or the indicator 534) may nudge up or down (clockwise or counter-clockwise) a specified number of wedges on the wheel 500 to identify a different, new award. The player could repeatedly surrender obtained awards and draw cards until opting to collect or drawing a collect card from the deck (or other random selection manner).

These bonus events providing gaming event options to accept or risk received awards can be used in connection with any game of chance, including slot games, poker games, keno, roulette, bingo, and the like. They may be provided using physical structures, or electronic structures created in computing hardware and displayed as virtual structures of such physical structures. As previously noted, the gaming events described herein may alternatively, or additionally, be provided as a base game of chance rather than a bonus or secondary event.

Figure 6A:
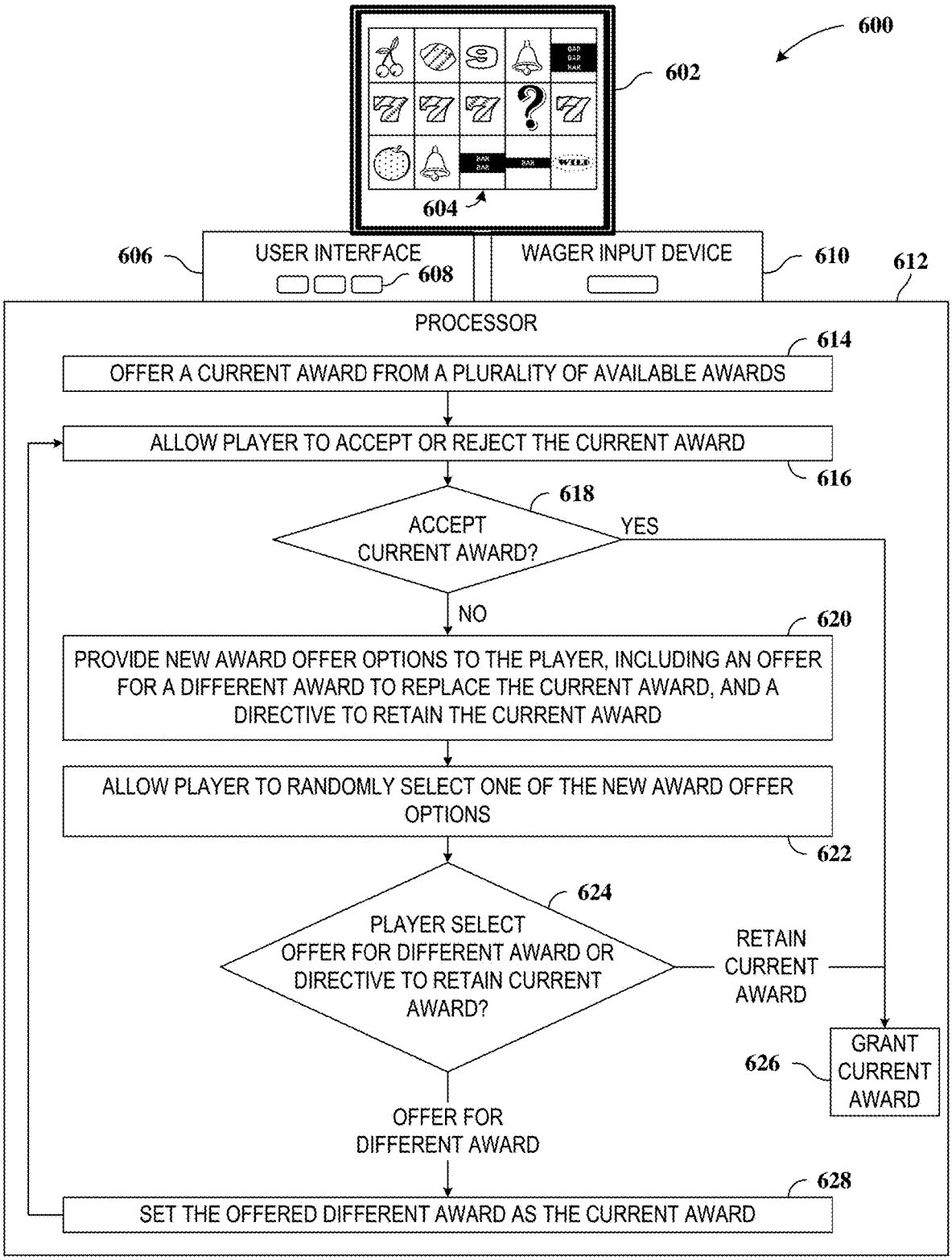
FIGS. 6A and 6B are block diagrams of representative slot game apparatuses for providing options in gaming events to accept or risk awards.

FIG. 6A is a block diagram of a representative slot game apparatus for providing options in gaming events to accept or risk awards. In this embodiment, a slot game device 600 is provided on which players can play slot games. The representative slot game device 600 includes at least a display 602 presenting a slot game symbol array or "grid" 604 of symbol locations, a user interface 606 including at least one user input 608 to enable a player to initiate a slot game event presented via the slot game grid 604, and a wager input device 610 structured to identify and validate player assets and ultimately permit the player to play the slot game event when the player assets are provided. The slot game device 600 also includes a processor 612 configured to offer 614 a current award from a bank of available awards, and allow 616 the player to either accept or reject the offered current award. If the player accepts the current award as determined at decision block 618, the current award is granted 626 to the player. Otherwise, if the player does not accept the current award but rather rejects it in the hopes of obtaining a more favorable award, new award offer options are provided 620 to the player. In one embodiment, the new award offer options include at least an offer for a different award from the plurality of available awards to replace the current award, and a directive to retain the current award. The player is allowed 622 to randomly select one of the new award offer options (although in other embodiments one of the new award offer options is selected by the system and presented to the player). It is determined 624 whether the player selected the offer for a different award or selected to retain the current award. If the player decides 524 to retain the current award, then the current award is granted 626 to the player. If the player decides 524 to surrender the current award and pursue an offer for a different award, the offered different award is set 628 to or otherwise becomes the current award. At this point, the player may begin the process over, where the new current award can be accepted or rejected, new award offer options can be presented and selected by the player, etc. In this manner, the player can continue to risk the current award as long as desired, until deciding to keep a current award or until the new award offer options cause the player to keep the current award and discontinue the pursuit of a more favorable award.

The slot game device 600 configures the processor 612 (which may include one or more cooperative processing devices) to structurally program functional elements into hardware modules. Processor 612 circuitry configuration thus changes based on the modules developed by software to carry out the desired methodology. For example, the processor 612 is programmed by software/code to create a hardware-based module to offer 614 a current award from a plurality of available awards, and to create other such software/code modules for each of the operations 614-628.

Figure 6B:
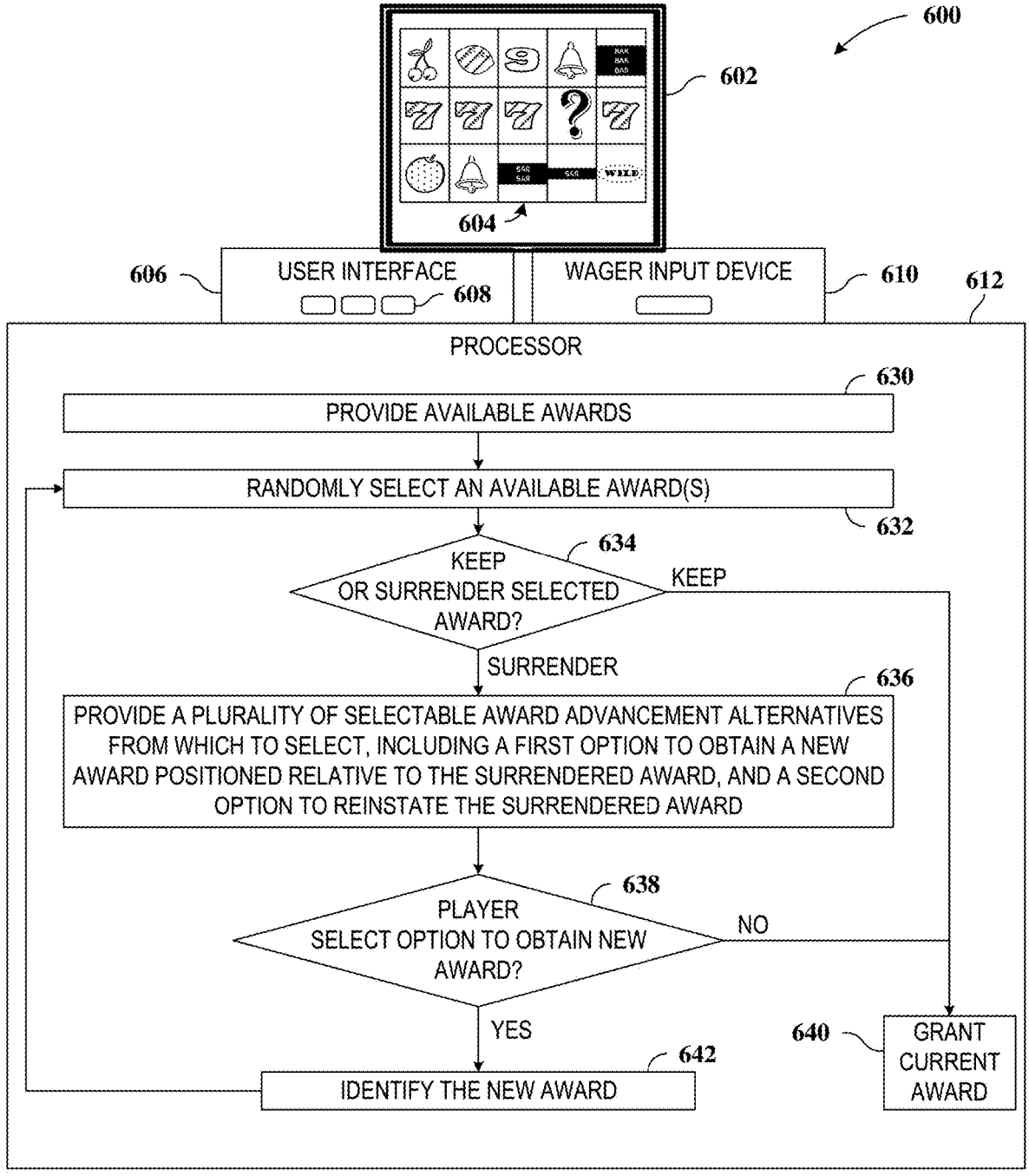

Other structural modules may be created on the slot game device using a properly configured processor 612. Referring now to the example of FIG. 6B, the processor 612 may be configured into programmed modules to provide 630 a grid of available awards, and randomly select 632 one (or more) of the available awards. The player is provided with an option to keep a currently-selected available award or to surrender the currently-selected available award for a chance to obtain an improved award, and the player makes this decision 634 whether to keep or surrender the selected award. If the player chooses to keep it, the current award is granted 640 to the player. If the player chooses to surrender the selected award and risk it to possibly obtain a different award, the player is provided 636 with selectable award advancement alternatives (including an option to obtain a new award positioned adjacent to the surrendered one of the available awards and an alternative requiring reinstatement of the surrendered one of the available awards). If the player does not select the option to obtain a new award as determined at decision block 638, in one embodiment the alternative selection is to retain the current award, which is then granted 640 to the player. Otherwise, if the player selected the option to obtain a new award as determined at decision block 638, the new award is identified 642 as a new award for the player to keep or further decide to surrender in the hopes of obtaining a more favorable award.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game device comprising:

a display presenting a plurality of symbol locations forming a symbol array;

a user interface including at least one user input to enable a player to initiate a slot game event presented via the symbol array;

a wager input device structured to identify and validate player assets, and to permit the player to play the slot game event when the player assets are provided; and a processor configured to:

provide a plurality of available awards;

randomly select one of the available awards;

providing a player an option to keep a currently-selected one of the available awards or to surrender the currently-selected one of the available awards for a chance to obtain a different award;

in response to the player surrendering the currently-selected one of the available awards, provide the player a plurality of concealed selectable award advancement alternatives from which to select, including an option to obtain a new award positioned relative to the surrendered one of the available awards and an option requiring reinstatement of the surrendered one of the available awards; and in response to the player selecting the option to obtain a new award positioned relative to the surrendered one of the available awards, identify the new award among the plurality of available awards.

2. The slot game device of claim 1, wherein the processor is configured to provide the plurality of available awards on a visible grid having respective ones of the available awards in different segments of the visible grid.

3. The slot game device of claim 2, wherein the processor is configured to provide the plurality of available awards on the visible grid such that the available awards having a relatively high value are separated by at least one of the available awards having a relatively low value.

4. The slot game device of claim 1, wherein the processor is configured to provide the plurality of available awards on a visible rotatable wheel having respective ones of the available awards in different segments of the visible rotatable wheel.

5. The slot game device of claim 4, wherein the processor is configured to provide the plurality of available awards on the visible rotatable wheel such that the available awards having a relatively high value are separated by at least one of the available awards having a relatively low value.

6. The slot game device of claim 1, wherein the processor is configured to identify the new award by selecting one of the plurality of available awards based on its relative position to the currently-selected one of the available awards.

7. The slot game device of claim 1, wherein the processor is further configured to enable player selection of any one of a plurality of the available awards that are within a predetermined proximity of the currently-selected one of the available awards.

8. The slot game device of claim 1, wherein the new award has a lower value than the previously selected one of the available rewards.

9. The slot game device of claim 1, wherein the new award has a greater value than the previously selected one of the available rewards.

10. A slot game device comprising:

a display presenting a plurality of symbol locations forming a symbol array;

a user interface including at least one user input to enable a player to initiate a slot game event presented via the symbol array;

a wager input device structured to identify and validate player assets, and to permit the player to play the slot game event when the player assets are provided; and a processor configured to:

(a) offer a current award from a plurality of available awards;

(b) facilitate player acceptance or rejection of the current award;

(c) in response to player rejection of the current award, provide a plurality of concealed new award offer options to the player, wherein the plurality of new award offer options include at least an offer for a different award from the plurality of available awards to replace the current award, and a directive to retain the current award;

(d) facilitate player selection of one of the plurality of new award offer options;

(e) grant the current award if the player selection resulted in the directive to retain the current award; and (f) establish the different award as the current award, and repeat (b)-(f) if the player selection resulted in the offer for the different award.

11. The slot game device of claim 10, wherein the processor is configured to grant the current award to the player, and discontinue further processing of (b)-(f), in response to player acceptance of the current award.

12. The slot game device of claim 10, wherein the processor is further configured to cause the display to present the plurality of available awards on a grid.

13. The slot game device of claim 10, wherein the processor is further configured to cause the display to present the plurality of available awards on a rotatable wheel.

14. The slot game device of claim 10, wherein the processor is configured to offer a current award from a plurality of available awards by randomly identifying the current award from a grid having grid positions each respectively providing one of the plurality of available awards.

15. The slot game device of claim 14, wherein the processor is configured to provide the new award offer option of an offer for a different award by providing an offer for one of the plurality of available awards positioned in one of the grid positions adjacent to the grid position of the current award.

16. The slot game device of claim 10, wherein the processor is configured to offer a current award from a plurality of available awards by randomly identifying the current award from a segment of an electronic rotatable wheel having multiple segments each respectively providing one of the plurality of available awards.

17. The slot game device of claim 16, wherein the processor is configured to provide the new award offer option of an offer for a different award by providing an offer for one of the plurality of available awards positioned in one of the segments of the wheel positioned adjacent to the segment of the wheel of the current award.

18. The slot game device of claim 10, wherein the processor is configured to offer the current award from the plurality of available awards in connection with a bonus event triggered by a predetermined symbol or combination of symbols in the symbol locations of the symbol array.

* * * * *